United States Patent [19]

Bergland et al.

[11] Patent Number: 5,016,182

[45] Date of Patent: May 14, 1991

[54] REGISTER CONTROL MEANS FOR WEB PROCESSING APPARATUS

[75] Inventors: Paul W. Bergland; James D. Parker, both of Brookfield; Thomas H. Timple, Pewaukee, all of Wis.

[73] Assignee: Stevens Graphics Corporation, New Berlin, Wis.

[21] Appl. No.: 291,819

[22] Filed: Dec. 29, 1988

[51] Int. Cl.[5] ..... G06F 15/46; B65H 23/18

[52] U.S. Cl. ..... 364/469; 226/28; 226/44

[58] Field of Search ..... 364/469, 468, 471, 559; 226/44, 27, 29, 30, 24, 2-3; 101/248, DIG. 42

[56] References Cited

U.S. PATENT DOCUMENTS

| | | | |
|---|---|---|---|
| 4,361,260 | 11/1982 | Hanlan | 364/469 |
| 4,719,575 | 1/1988 | Gnuechtel | 364/469 |
| 4,719,855 | 1/1988 | Cannon et al. | 364/469 |
| 4,888,717 | 12/1989 | Ditto et al. | 364/469 |

*Primary Examiner*—Joseph Ruggiero
*Attorney, Agent, or Firm*—Nilles & Nilles

[57] ABSTRACT

A register control for web processing apparatus operates to match the surface speed of a metering roll which supplies a preprinted web to a cutting zone in a cutter mechanism to the surface speed of an impression cylinder which applies impressions and associated register marks to said web. The register control also effects registration between the impressions and the cutting zone. The web processing apparatus comprises a register control motor for the metering roll and a movable dance engageable with the web at a location between the impression cylinder and the said metering roll. The register control comprises base speed selector means and circuits for operating the register control motor to establish and maintain a base speed for the web; error correction sensors and circuits for ascertaining a register error, if any, and for adjusting the base speed to establish a corrected base speed to eliminate the register errror; dancer position locater sensors and circuits for ascertaining and remembering a null position assumed by the dancer when the web is operating at corrected base speed; and for subsequently recalling the null position to enable an initial or start-up operation of the register control motor at a speed wherein the dancer assumes the recalled null position when the web is engaged with the dancer.

6 Claims, 13 Drawing Sheets

REGISTER CONTROL MEANS FOR WEB PROCESSING APPARATUS

BACKGROUND OF THE INVENTION

1. Field of Use

This invention relates generally to improved register control means for web processing apparatus.

2. Description of the Prior Art

Many products, such as frozen foods and canned or bottled drinks, are marketed in cartons on which graphics are printed. Such cartons are formed by folding pre-printed blanks which are cut from a paperboard web. The blanks are formed by running a continuous paperboard web through web processing apparatus which typically comprises a multicolor gravure type printing press and a cutter-creaser press located downstream of the printing press. The printing press comprises a series of printing stations, one for each color, which cooperate to form a succession of multicolor printed impressions and associated register marks on the web. Each printing station comprises a rotary impression cylinder which has a certain circumference or repeat length which, for example, typically ranges from 17" to 40", depending on the size selected for a specific press run. The cutter-creaser press, which is marketed as a separate machine for use with printing presses having impression cylinders of various circumferences (repeat lengths), is designed and constructed to take this fact into account.

As FIG. 13 shows, one prior art cutter-creaser press manufactured and sold by the same assignee as the present invention (designated as Model VP3000) comprises a reciprocating cutter-creaser mechanism having a cutting zone wherein cutter blades and creaser blades are located to cut pre-printed foldable blanks from the web. The cutter-creaser press further comprises a pair of continuously rotating metering rolls, one being a motor-driven metering roll, defining a nip which engages the preprinted web and feeds it from the impression cylinder in the last printing station to the cutter-creaser mechanism. The cutter-creaser press further comprises components which ensure that the impressions on the web properly register with the cutting zone in the cutter-creaser mechanism. Such components include a movable dancer located between the impression cylinder and the metering rolls to maintain tension on the web. A movable curve plate and a pair of intermittently operable cutter feed rolls are located between the metering rolls and the cutter-creaser mechanism. In operation, the cutter-creaser mechanism moves reciprocably between open (infeed) and closed (cutting) positions. When the cutter-creaser mechanism is open, the cutter feed rolls close and feed a length of web into the cutting zone. When the cutter creaser mechanism is closed, the cutter feed rolls open to momentarily stop web feed into the cutting zone and the movable curve plate moves to take up the slack in the web which is being continuously fed by the metering rolls.

Generally speaking, proper registration of the blades in the cutting zone and a printed impression on the web is obtained by matching the surface speed [feed-up]of the metering rolls to a specific printed mark applied by the impression cylinder in any previous printing station. Print-to-cut register error is a direct function of the preciseness of this surface speed or feed-up.

The reciprocating cutter-creaser mechanism is driven by a main drive motor. However, as previously mentioned, the circumference (repeat length) of the last impression cylinder can vary between 17" and 40", depending on job requirements, whereas the metering roll circumference has a fixed predetermined circumference. Therefore, the cutter-creaser mechanism is provided with a variable ratio power transmission unit which is connected between the main drive motor and both the cutter-creaser mechanism and the metering rolls to obtain the required surface speed match.

The variable ratio power transmission unit comprises a set of change gears and a variable ratio planetary differential.

A set of change gears of appropriate size is selected and manually installed so as to adjust the speed of the metering rolls within a 2% increment of the desired repeat length which is to be produced.

The planetary differential is used as an infinitely variable ratio device to further adjust the speed of the metering rolls to any value within the 2% increment range provided by the change gears. The ratio of the planetary differential is adjusted by rotating the cage of the planetary differential using a high response, low armature inertia, DC servo motor, hereinafter referred to as a register control motor. The register control motor is connected to the cage of the planetary differential using an integral 60:1 ratio worm gear drive, for example, to prevent tension feedback from the running web.

The prior art register control means shown in FIG. 13 for the aforedescribed Model VP3000 cutter-creaser press includes the following electrical devices, namely: a dancer position sensor, a register mark scanner located just ahead of the metering rolls, a metering roll encoder, a motor control unit for the register control motor and a cut-stroke signal generator.

The prior art register control means further includes electric control circuits for receiving electric output signals from the aforesaid electrical devices and for providing electric output signals to the motor control unit to effect registration.

The operator's control unit for the prior art register control is shown in FIG. 14 and employs five visual display devices, including an oscilloscope, which need to be monitored by the operator, numerous manually controlled switches and two manually controlled potentiometers P1 and P2 which need to be manually adjusted during set-up and running to effect registration. One potentiometer P2 sets the base speed of the register control motor during set-up. The other potentiometer P1 operates to adjust the position of the dancer during set-up to ensure proper registration. In the prior art system, it was necessary for the operator to frequently adjust potentiometers P1 and P2 when restarting the system after a shutdown to maintain registration.

SUMMARY OF THE PRESENT INVENTION

Improved register control means in accordance with the present invention is applicable to a cutter-creaser press similar to that hereinbefore described.

More specifically, in its broadest aspect, the improved register control means operates to match the surface speed of the rotatable metering roll driven by the adjustable speed register control motor and to the surface speed of the rotatable impression cylinder at some selected base speed. It also operates to effect registration between the impressions, appearing on the web being supplied to the cutting zone in the cutter mechanism. The web processing apparatus further comprises a free-floating, adjustably movable dancer which engages the web at a location between the impression cylinder and the metering roll. When the web is properly registered, the dancer assumes a certain null position. In accordance with one aspect of the invention, means are provided for adjustably positioning the dancer in null position when the web is in engagement therewith. The register control means comprise: a register mark sensor; a dancer position sensor; a metering roll encoder driven by the metering roll; a tachometer driven by the register control motor; a cut-stroke signal generator driven by the cutter mechanism; a plurality of manually operable signal input switches including a base speed signal switch; a visual display; and an improved electronic controller for receiving input signals from the switches and the several sensing devices. The electronic controller is operable:

- to receive and process a base speed signal from the base speed signal switch and to provide a base speed control signal to effect operation of the register control motor at a selected base speed;
- to receive and process output signals from the metering roll encoder and the tachometer and to provide correction control signals to the base speed control signal to maintain a predetermined fixed speed ratio between the output signals from the metering roll encoder and the tachometer;
- to receive and process register mark position signals and cut-stroke signals and, when misregistration occurs, to provide correction control signals to the base speed control signal until misregistration is corrected.
- to receive, store and recall a dancer null position signal to enable pre-adjustment of the dancer at start-up.

The electronic controller employs the cut stroke signals and the register mark position signals to ascertain that misregistration is occurring, to effect correction of misregistration and subsequently to ascertain that misregistration has been corrected. The electronic controller employs the dancer position signals to ascertain a dancer null position signal that indicates when registration is occurring. The electronic controller compares the dancer position signals to the dancer null position signal which is stored in a memory to initially locate the dancer in null position.

The improved register control means comprises an improved electronic controller, and associated circuits, employing solid state components and circuits which are arranged in accordance with the present invention to reduce the number of visual displays required to be monitored by the operator, to simplify the visual display, to reduce the number of manually operated switches requiring actuation by the operator, and to eliminate all rheostats requiring manipulation by the operator in accordance with visual displays to effect set-up and running of the cutter-creaser press.

The electronic controller of the improved register control means employs dual microprocessor circuits and memory circuits to automatically effect set-up and regisration during set-up and running, thereby substantially reducing monitoring and input operations required by the operator and simplifying set-up.

The improved electronic controller is more compact in size, more economical to manufacture, simpler to operate and less error-prone than the prior art electronic controller it replaces. Other objects and advantages will hereinafter appear.

DRAWINGS

DESCRIPTION OF A PREFERRED EMBODIMENT

Figure 1:
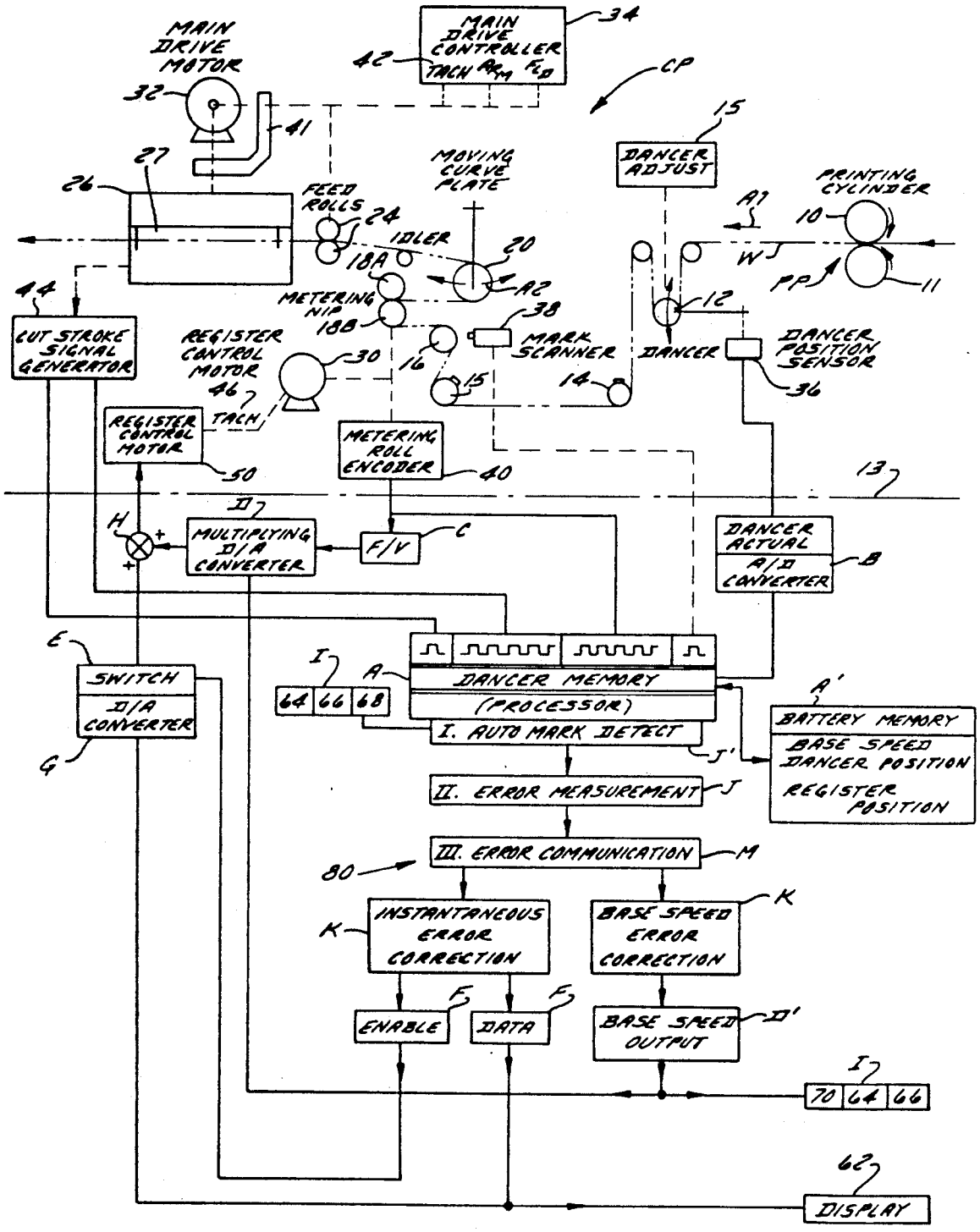
FIG. 1 is a schematic diagram of a cutter-creaser press for web processing apparatus and improved register control means therefor.

FIG. 1 is a schematic diagram of a cutter-creaser press CP in a web processing apparatus employing improved register control means in accordance with the present invention. In FIG. 1, those components above a dashed line 13 comprise components of cutter-creaser press CP and certain components of the improved register control means. In FIG. 1, those components below dashed line 13 are additional components of the improved register control means.

Figure 13:
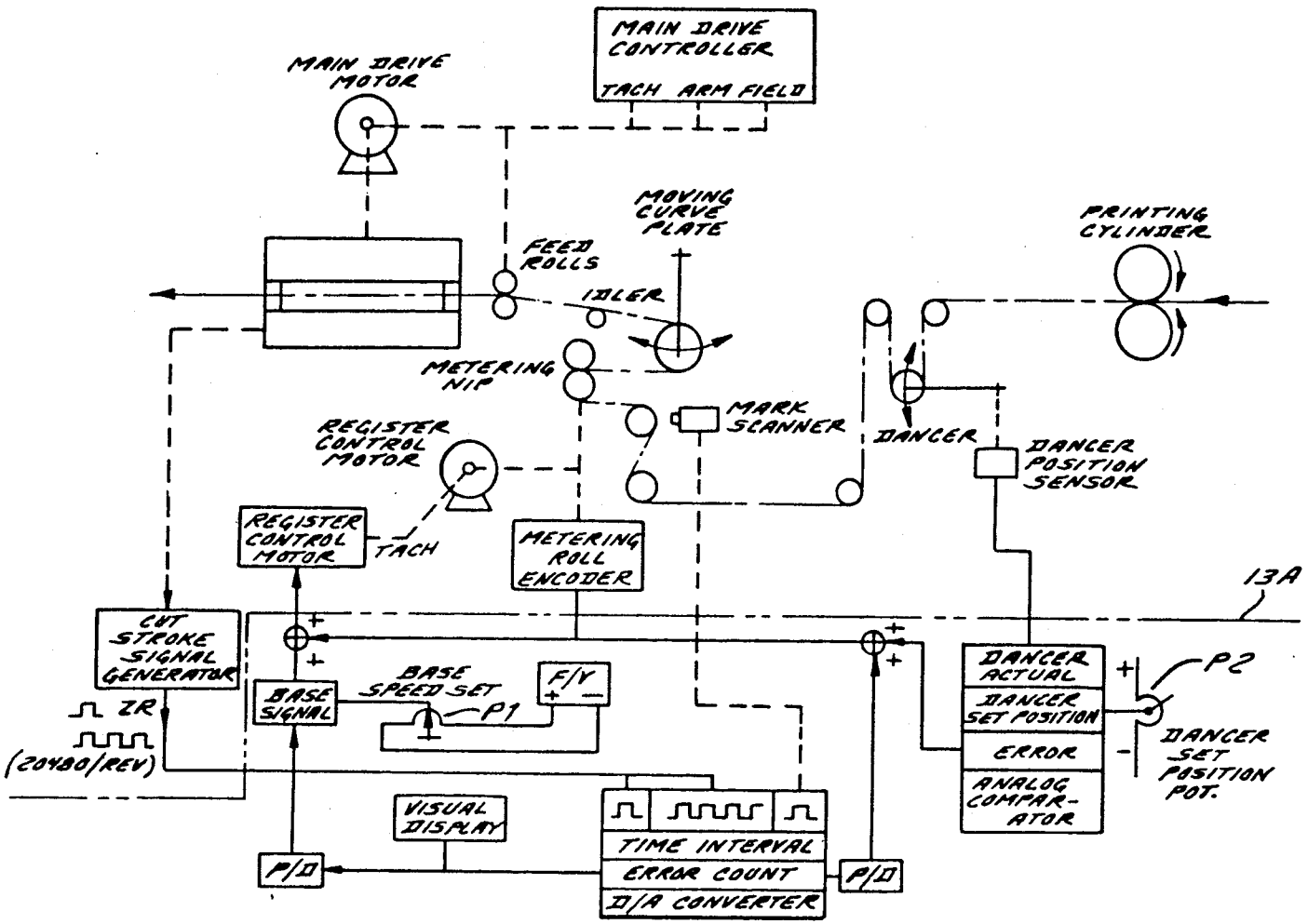
FIG. 13 PRIOR ART
FIG. 13 is a schematic diagram of a cutter-creaser press, generally similar to that in FIG. 1, but showing prior art register control means therefor.

In FIG. 13, those components above a dashed line 13A are the same as those hereinafter described in connection with FIG. 1. In FIG. 13, those register control components below dashed line 13A are prior art register control components.

Figure 4:
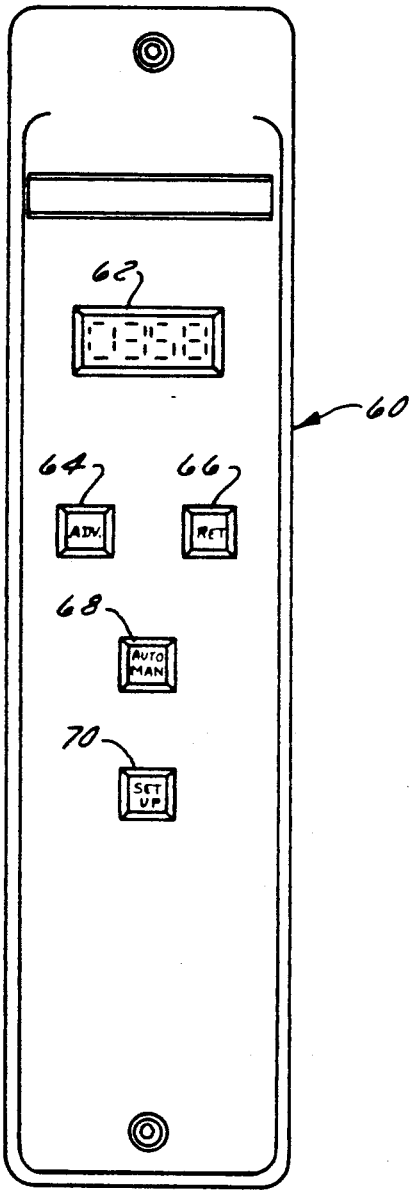
FIG. 4 is a front elevation view of an operator's control panel of the register control means of FIG. 1.
Figure 14:
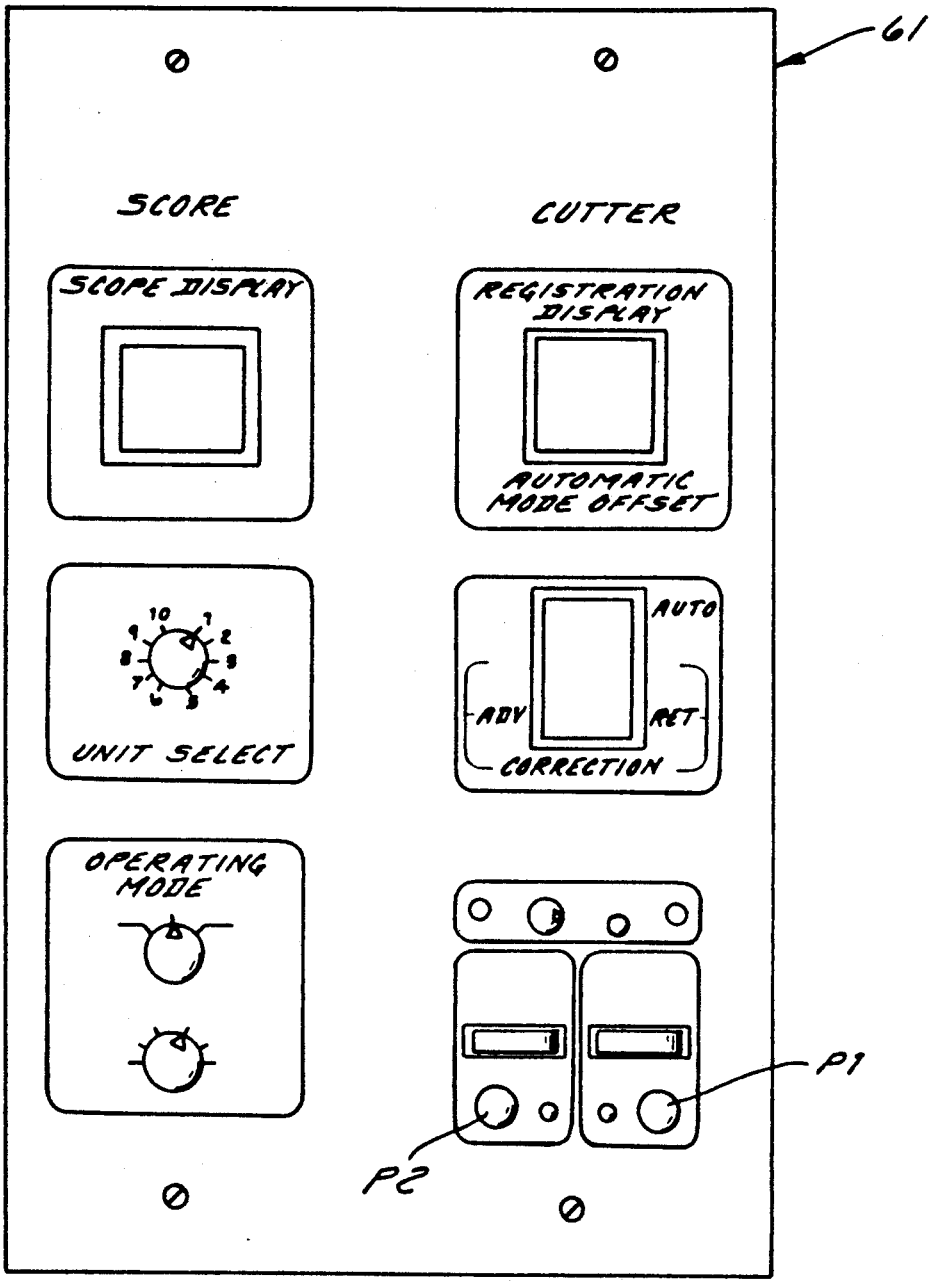
FIG. 14 PRIOR ART
FIG. 14 is a front elevation view of a prior art operator's control panel for the prior art register control means of FIG. 13.

FIGS. 4 and 14 are elevation views of the front control panels of operator's control units 60 and 61, respectively, of the improved register control means of FIG. 1 and the prior art register control means of FIG. 13.

FIG. 1 shows that the web processing apparatus comprises a printing or impression cylinder 10 which is part of a printing press PP and a cutter-creaser press CP is located downstream of printing cylinder 10.

The cutter-creaser press CP comprises a reciprocating type cutter-creaser mechanism 26 having a cutting zone 27 wherein cutter blades (not shown) and creaser blades (not shown) are located to cut pre-printed foldable blanks (not shown) from a paperboard web W. The press CP further comprises a pair of continuously rotatable metering rolls 18 and 18A defining a nip which engages preprinted web W and feeds it in the direction of arrow A1 from impression cylinder 10 in the last printing station of printing press PP to cutter-creaser mechanism 26. The press CP further comprises components which ensure that the printed impressions 52 on web W (see FIG. 2) properly register with cutting zone 27 in cutter-creaser mechanism 26. Such components include a free-floating movable dancer 12 located between impression cylinder 10 and metering roll 18 to maintain tension on web W. Dancer adjustment means 15 are provided to initially position dancer 12 in a null position. A freefloating movable curve plate 20, biased in the direction of arrow A2, and a pair of rotatable, periodically separable cutter feed rolls 24 are located between metering roll 18 and cutter-creaser mechanism 26. In operation, cutter-creaser mechanism 26 moves reciprocably between open (infeed) and closed (cutting) positions. When cutter-creaser mechanism 26 is open, the cutter feed rolls 24 close and feed one repeat length of web W into cutting zone 27. When cutter-creaser mechanism 26 is closed, the cutter feed rolls 24 open to momentarily stop web feed into cutting zone 27 and movable curve plate 20 moves in the direction of arrow A2 to take up the slack in web W which is being continuously fed by metering roll 18. Idler rollers 14, 15 and 16 are located between dancer 12 and metering roll 18. An idler roller 22 is located between curve plate 20 and the cutter feed rolls 24.

Proper registration of the blades (not shown) in cutting zone 27 and a printed impression 52 on web W (see FIG. 2) is obtained by matching the surface speed of metering roll 18 to the surface speed of impression cylinder 10 in the last printing station. More specifically, the feed-up of the web is matched to the application of the register mark. Print-to-cut register error is a direct function of the preciseness of this surface speed match.

The reciprocating cutter-creaser mechanism 26 and the feed rolls 24 are driven by a main drive motor 32 which is operated by a main drive controller 34. However, the circumference (repeat length) of impression cylinder 10 installed in printing press PP can vary between 17" and 40", depending on job requirements, whereas the circumference of metering roll 18 has a fixed predetermined circumference. Therefore, cutter-creaser mechanism 26 is provided with a variable ratio power transmission unit 41 (see FIGS. 1 and 3) which is connected between main drive motor 32 and both the cutter-creaser mechanism 26 and metering roll 18 to obtain the required surface speed match.

Figure 3:
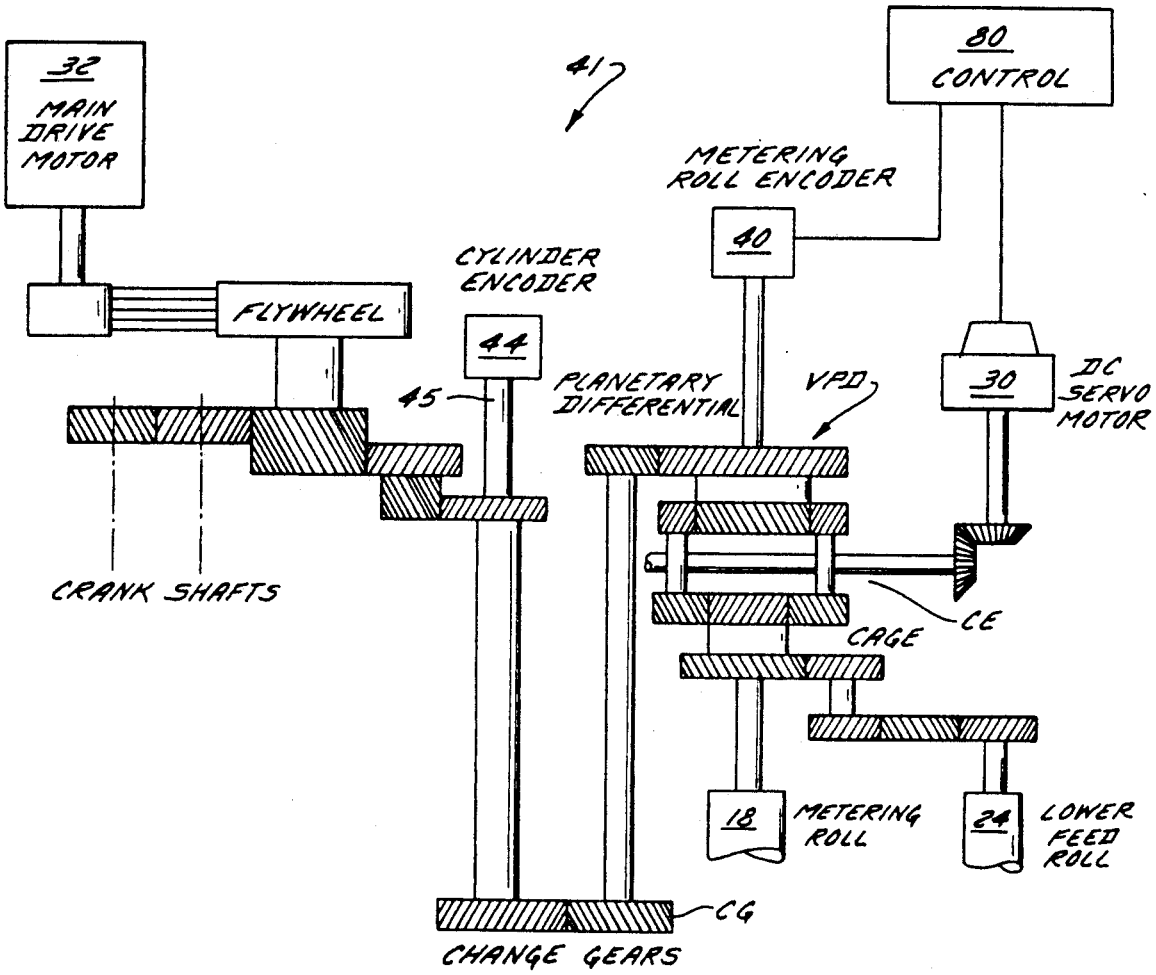
FIG. 3 is a schematic diagram of a variable ratio power transmission unit employed in the cutter-creaser press of FIG. 1.
Figure 5:
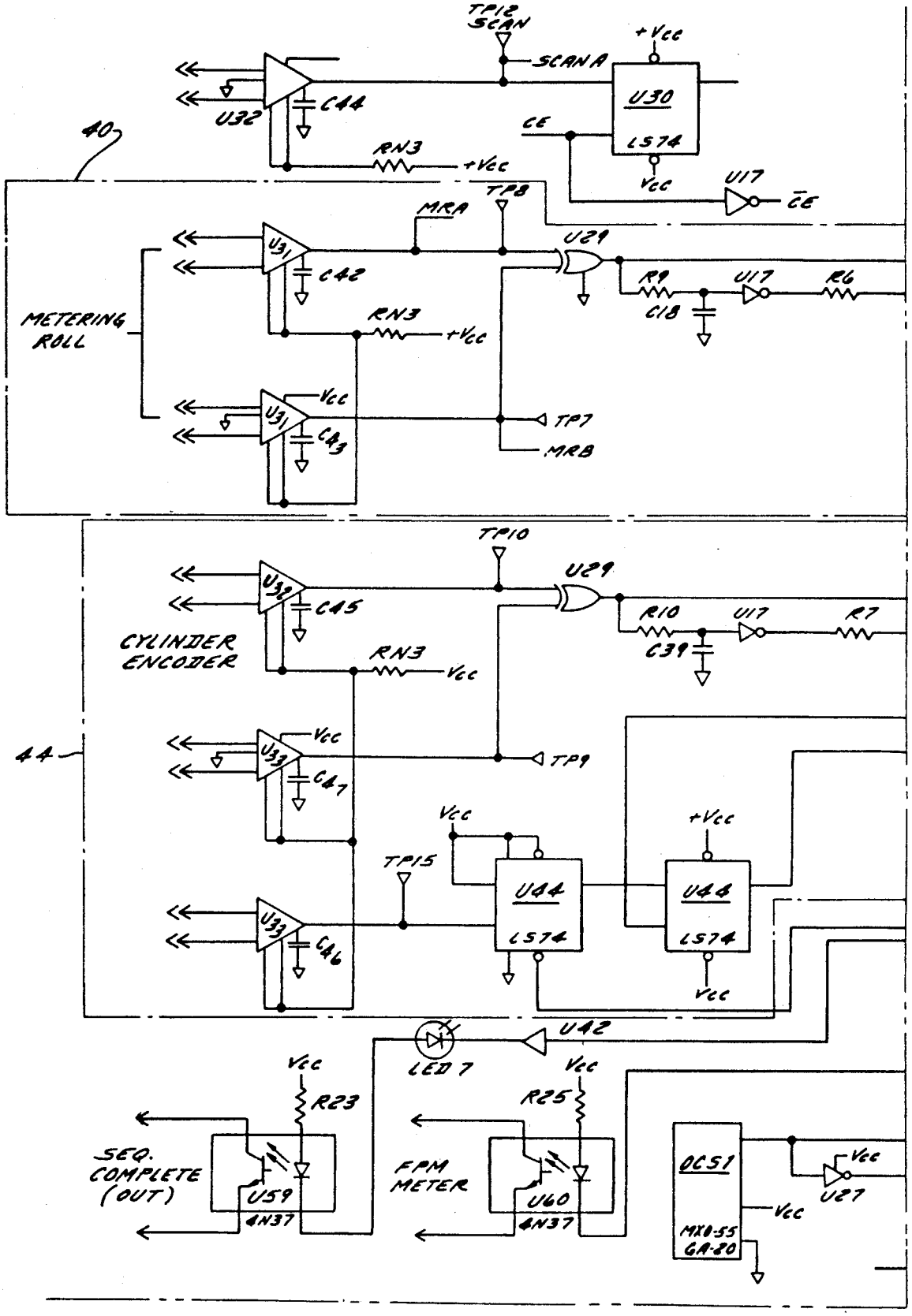
FIGS. 5 through 12 are electric circuit diagrams which, taken together, depict the electronic control circuit of the register control means depicted schematically in FIG. 1.
Figure 6:
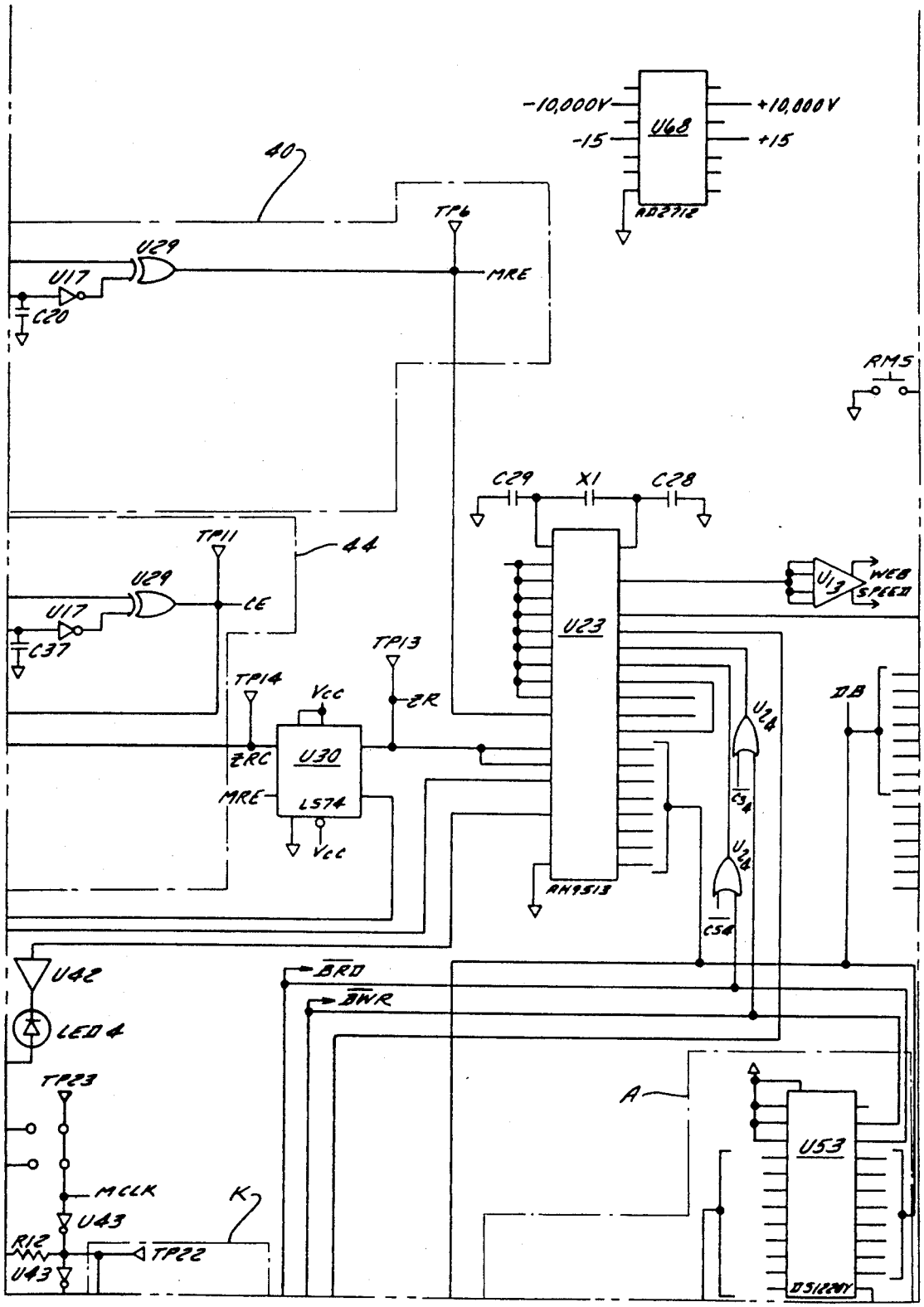
Figure 7:
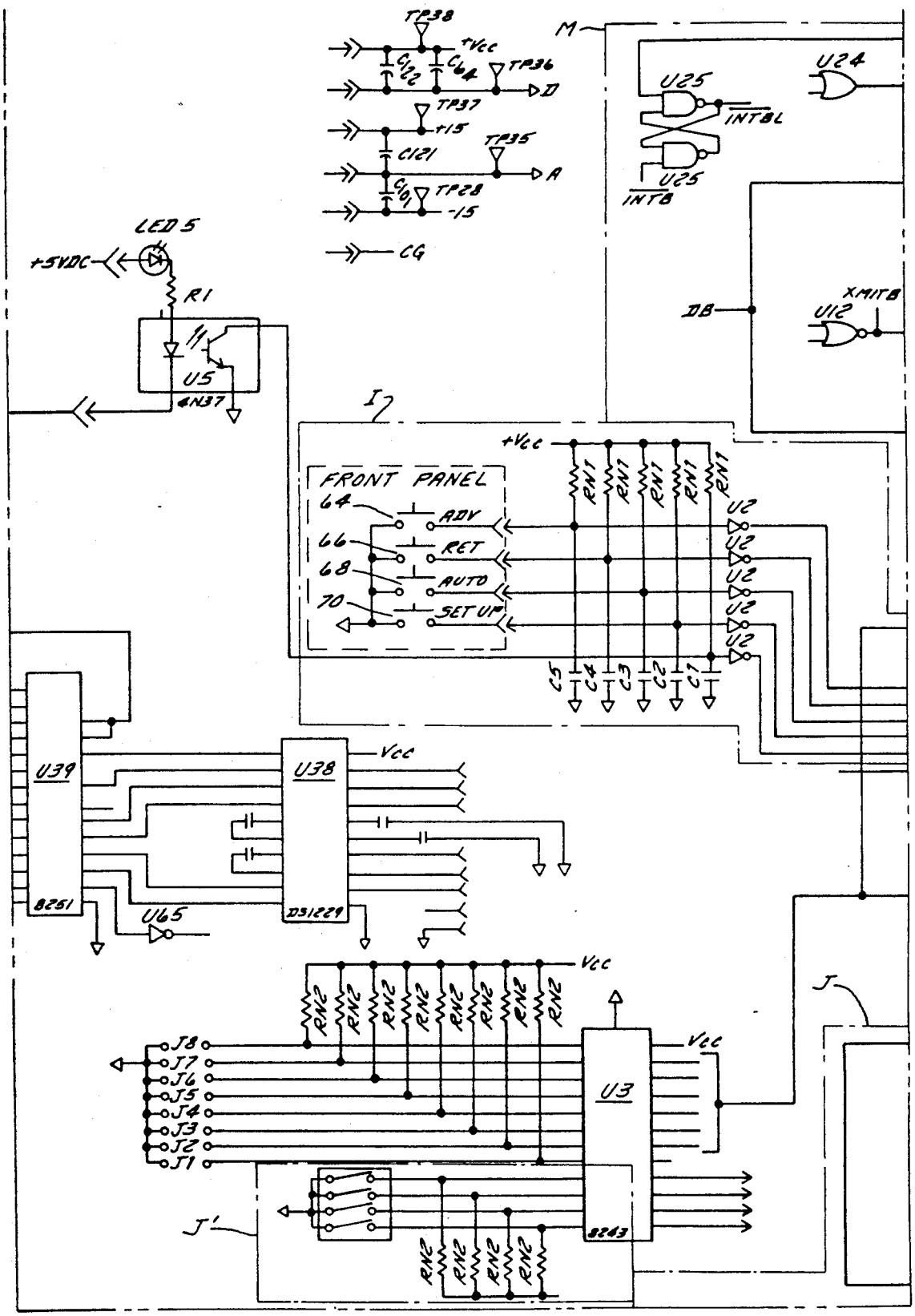
Figure 8:
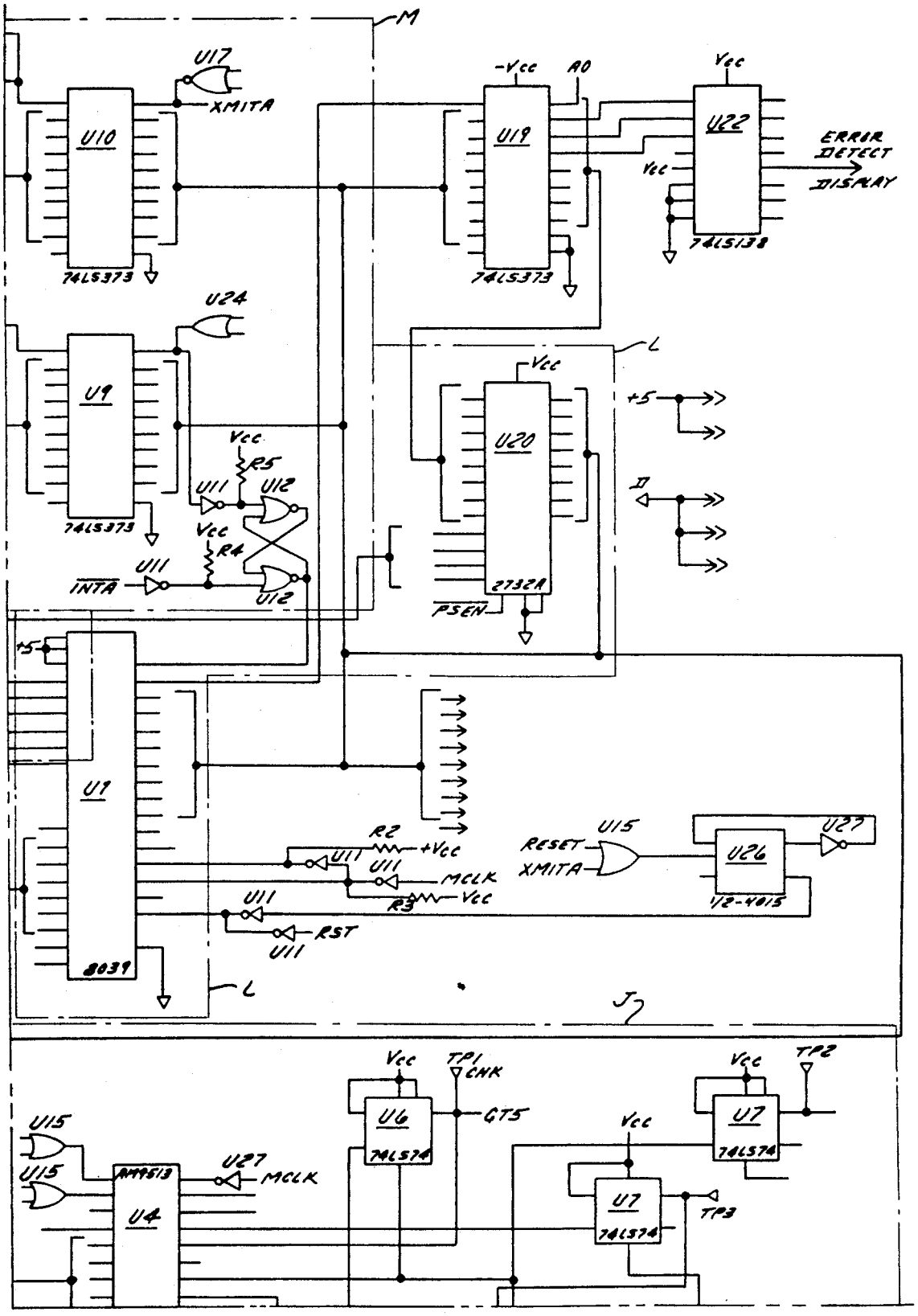
Figure 9:
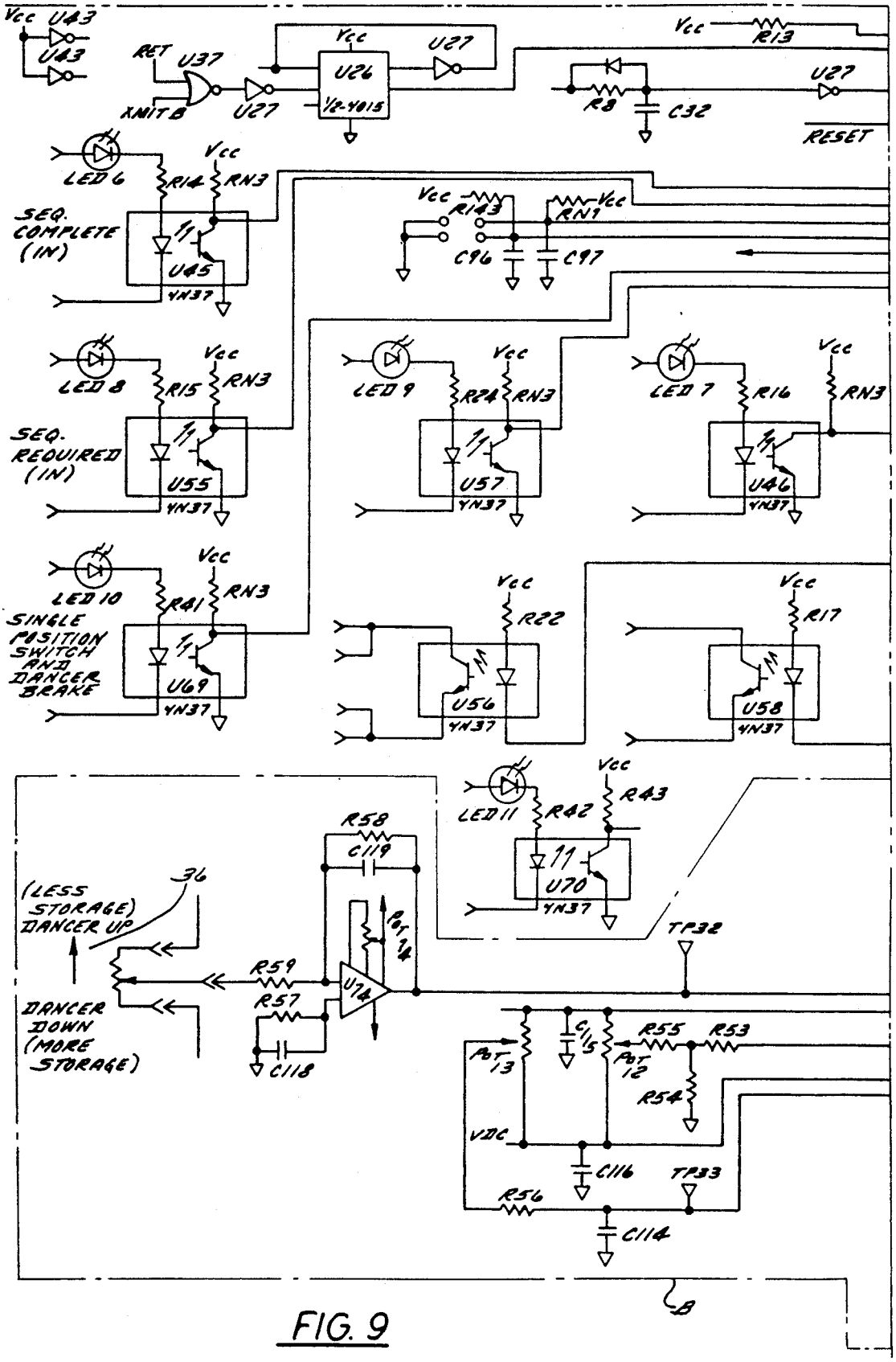
Figure 10:
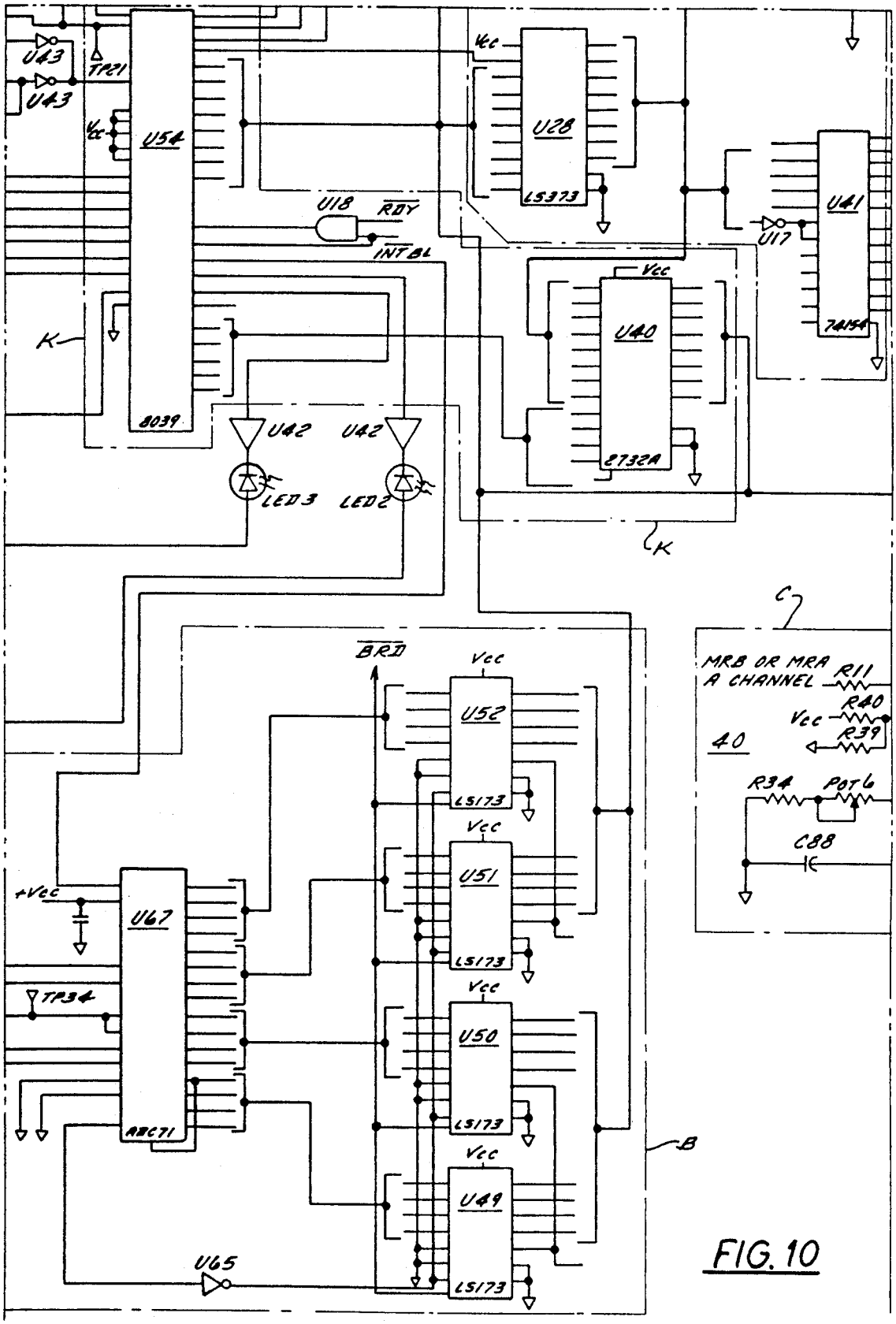
Figure 11:
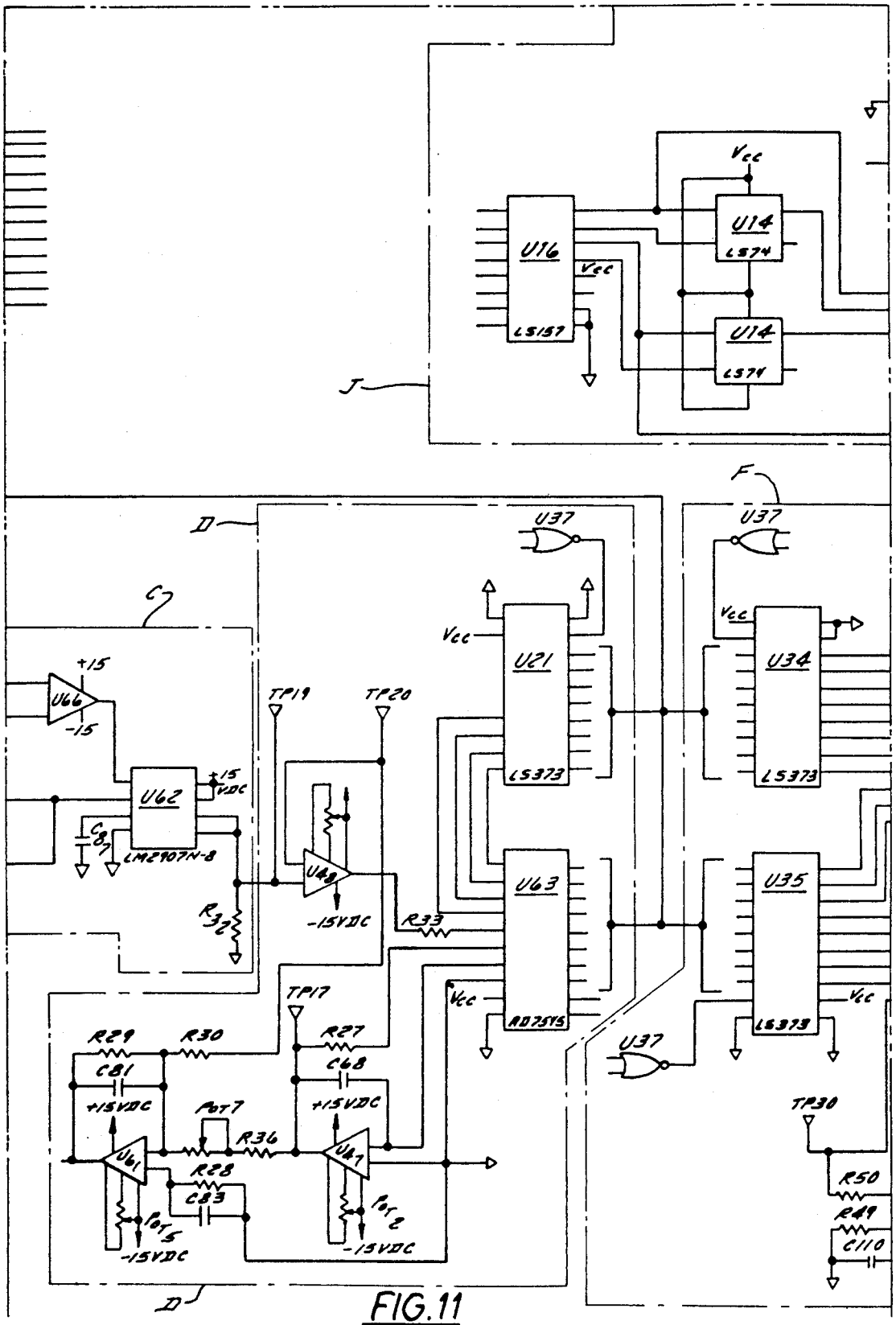
Figure 12:
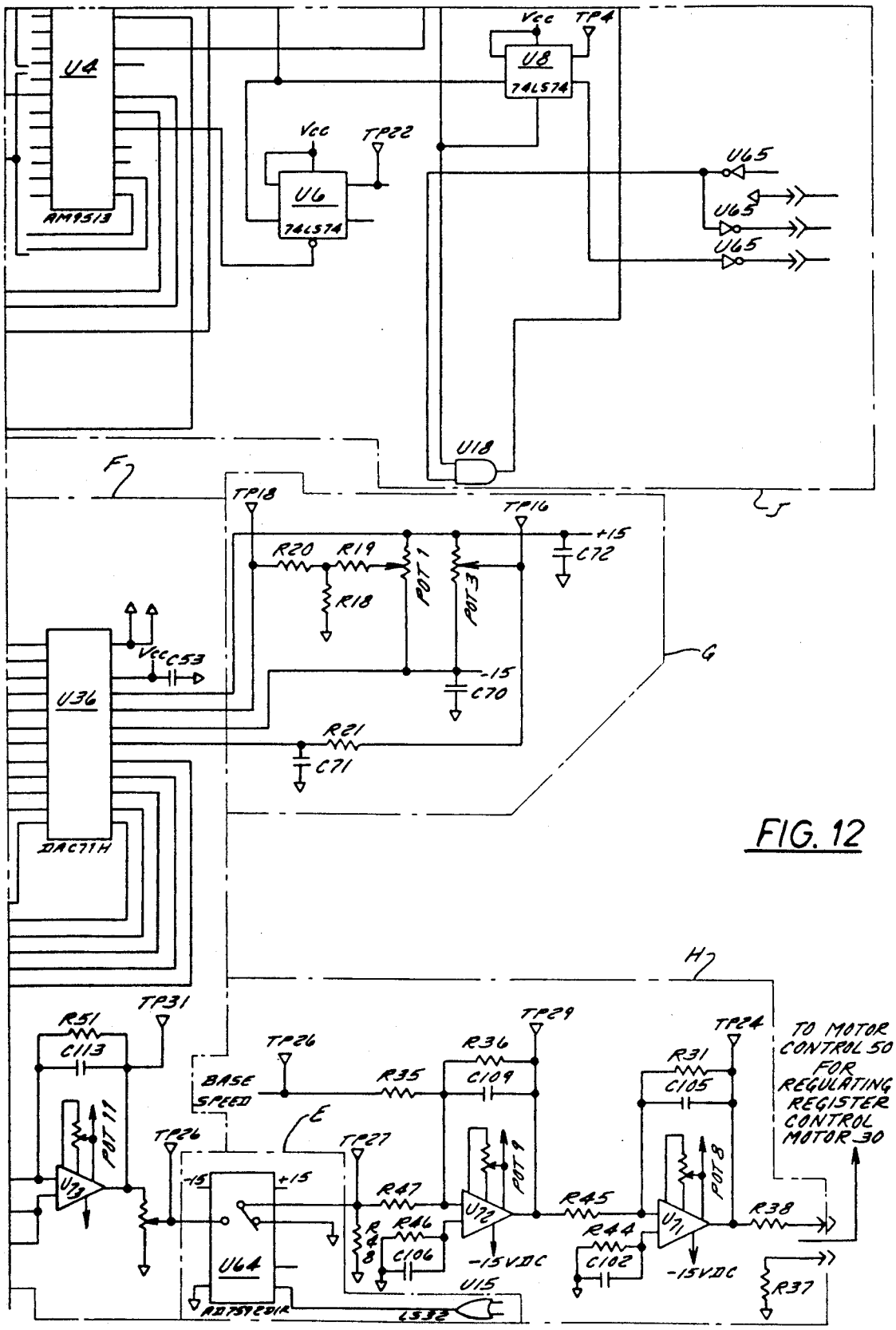

As FIG. 3 shows, variable ratio power transmission unit 41 comprises a set of change gears CG and a variable ratio planetary differential VPD.

A set of change gears CG of appropriate size (determined by a chart, not shown, available to the operator) is selected and manually installed so as to adjust the speed of metering roll 18 within a 2% increment between the selected repeat length RL (see FIG. 2) which is to be produced by impression cylinder 10.

The planetary differential VPD functions as an infinitely variable ratio device to further adjust the speed of metering roll 18 to any value within the 2% increment range provided by the selected set of change gears CG. The ratio of planetary differential VPD is adjusted by rotating the cage CE of planetary differential VPD using a high response, low armature inertia, DC servo motor, hereinafter referred to as a register control motor 30 (see FIGS. 1 and 3). The register control motor 30 is connected to cage CE of planetary differential VPD using an integral 60:1 ratio worm gear drive (not shown), for example, to prevent tension feedback from the running web W.

As FIG. 1 shows, register control means for the cutter-creaser press CP includes the following electrical devices, namely: a dancer position sensor 36, a register mark scanner 38 located just ahead of metering roll 18, a metering roll encoder 40, a motor control unit 50 for register control motor 30 and a cut-stroke signal generator or cylinder encoder 44. The register control means also include a tachometer 42 in main motor controller 34 and a tachometer 46 for register control motor 30.

Register mark scanner 38 is a fiber optic scanner for viewing the printed register marks 54 on running web W wrapped around idler roll 16 prior to reaching metering roll 18.

The cut-stroke signal generator or cylinder encoder 44 is an optical encoder driven from a cam shaft 45 (see FIG. 3) on cutter mechanism 26 and has the following outputs: 10240 digital 5 volt pulses per crankshaft revolution; and a 1 digital 5 volt pulse per revolution of the crankshaft. The function of cylinder encoder 44 is to generate a single pulse per repeat length to be used as a starting and ending point for controller 80 and to establish a count value within that repeat length where the print-to-cut register mark 54 will be located.

Metering roll encoder 40 is an optical encoder driven from metering roll 18 with an output of 5780 digital 5 volt pulses per revolution, and geared to provide 1 pulse per 0.001 inches of the metering roll surface. The function of encoder 40 is to generate pulses equivalent, for example, to 0.001 inches of web movement. These pulses are used to establish the correct base speed value during initial set up, to provide a press speed reference to electronic controller 80 and to provide a count which will accurately measure the amount of error seen during each repeat.

Register control motor 30 is a DC servo motor with an integral 6V/1000 RPM tachometer 46. The function of the servo motor 30 is to drive the differential planetary VPD in transmission unit 41 (see FIG. 3) at the proper speed to match metering roll surface speed to that of web speed. This motor speed is also pulsed for making error corrections.

The motor control unit 50 is a servo drive which is used to establish the proper operating voltages required to drive register control motor 30. The electronic controller 80, along with other control components, controls the input voltage level to servo drive unit 50 which then produces and maintains the proper signal output levels to register control motor 30.

Dancer position sensor 36 is a potentiometer operated by dancer 12 which is used to sense the location of dancer roll 12. Sensor 36 is used during initial set-up to indicate dancer location and stability, and on automatic press start ups, to indicate the proper dancer location (i.e., a null position wherein the dancer is stationary) for the correct print-to-cut register.

Figure 2:
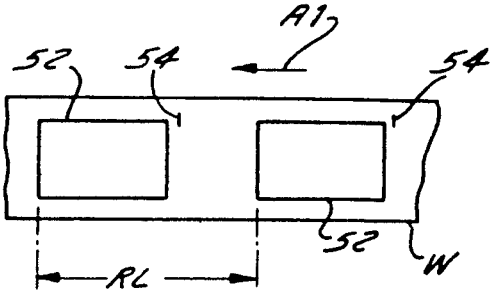
FIG. 2 is a plan view of a portion of a web having a succession of printed impressions formed thereon.

When the web processing apparatus of FIG. 1 is in operation, the metering rolls 18 and 18A pull web W from the impression cylinders 10 and 11. As FIG. 2 shows, impression cylinder 10 prints a succession of printed impressions 52 on web W, each having the same predetermined repeat length L, and also prints a printed register mark 54 adjacent each printed impression.

The intermittently operable cutter feed rolls 24, which preferably take the form of air-loaded rubber-covered rolls, ultimately feed web W into cutter-creaser mechanism 26 which cuts a succession of blanks (not shown) therefrom, each blank containing a printed impression 52. Cutter mechanism 26 contains cutting zone 27 wherein cutter-blades (not shown) and creaser blades (not shown) are arranged to normally register with each printed impression 52 in some preferred manner when a cutting stroke of cutter mechanism 26 occurs.

The creaser blades (not shown) operate simultaneously with the cutter blades (not shown) to form creases or fold-lines on the blank and which also normally register with the printed impression in some preferred manner.

The register control means operates to feed the exact amount of web W into cutting zone 27 that is equal in length to one repeat length RL containing an impression 52 on the web. The register control means includes those components, including an electronic controller 80 and other components, necessary to match and maintain the surface speed of metering roll 18 to the surface speed of impression cylinder 10. Print-to-cut register error is a direct function of the preciseness of this surface speed match.

The electronic controller 80 is operable:

to receive and process a base speed signal from a base speed signal switch 70, also hereafter referred to as a set-up switch, and to provide a base speed control signal to effect operation of register control motor 30 at a selected base speed;

to receive and process output signals from metering roll encoder 40 and tachometer 46 and to provide correction control signals to the base speed control signal to maintain a predetermined fixed speed ratio between the output signals from metering roll encoder 40 and tachometer 46;

to receive and process register mark position signals from mark scanner 38 and cut-stroke signals from signal generator 44 and, when misregistration occurs, to provide correction control signals to the base speed control signal until misregistration is corrected; and to receive, store and recall the dancer position signals to ascertain a dancer null position signal that indicates when misregistration is occurring. The electronic controller 80 compares the dancer position signals to the dancer null position signal which is stored in a dancer memory circuit A to initially locate dancer 12 in null position wherein misregistration will not occur.

Referring now to FIGS. 1 and 4, the register control means comprises an operator's control unit 60 which comprises a four-digit numeric display 62, and four lighted pushbuttons, namely: a web advance pushbutton switch 64, a web retard pushbutton switch 66, an auto select pushbutton switch 68 and a setup pushbutton switch 70. The four pushbutton switches 64, 66, 68 and 70 control the operation of the register control means. The lights within the plastic actuators of the four switches indicate to the operator the status or mode (manual or automatic) the register control means is currently in. The four digit display 62 displays the repeat length in set-up, the error seen by the mark scanner 38 eye in thousandths of inches in automatic or manual mode, the offset count when the "ADV" switch 64 or "RET" switch 68 is pressed in automatic mode, or an error code when a system fault is detected. Only one of these functions will be displayed at a time.

Before describing the structure and operation of the control circuitry in detail, a brief description of the steps carried out by the operator for setting up and running the apparatus will be discussed immediately below.

BASE SPEED SETUP

First, the appropriate change gears CG are installed by the operator.

Second, without web W in place, the operator positions moving curve plate 20 to a predetermined position defined in a pre-make ready chart (not shown).

Third, without web W in place, the operator presses base speed setup pushbutton switch 70 and its light will then flash on and off.

Fourth, without web W in place, the operator presses web advance pushbutton switch 64 or web retard pushbutton switch 66 to set digital display 62 to the desired repeat length corresponding to the repeat length RL for the impressions 52 on web W. The operator pushes swith 70 again to lock the repeat length in the memory.

Fifth, without web W in cutter mechanism 26, the operator runs cutter mechanism 26 at any speed, typically a go-down speed, and, when a selected initial base speed is automatically set by electronic controller 80, the light in setup pushbutton switch 70 stops flashing and turns on steady.

Sixth, with web W in cutter mechanism 26, the operator runs cutter mechanism 26 at any speed and, when the final base speed is automatically set, the light in setup pushbutton switch 70 turns off.

DANCER POSITION SETUP

The dancer 12 is automatically moved by controller 80 to null position.

CUT-OFF ADJUSTMENT

Seventh, the operator presses advance pushbutton switch 64 or retard pushbutton switch 68 until visual inspection of cut blanks (not shown) reveals that cut-off is occurring at the proper location, i.e., in registry with the impression 52.

MARK IDENTIFICATION AND AUTO SELECT

Eighth, the operator presses automatic mode select pushbutton switch 68 and its light flashes until a valid register mark 54 is found, whereupon its light turns on steady.

DETAILED DESCRIPTION OF REGISTER CONTROL MEANS

The improved print-to-cut register control means includes electronic controller 80 which comprises dual microprocessor circuits, the functions of which are to:

1. receive signals from the operator controls including the pushbutton switches 64, 66, 68, 70;
2. receive signals from dancer position sensor 36, mark scanner 38, metering roll encoder 40, and cut-stroke signal generator 44, tachometer 42 and tachometer 46;
3. provide set-up functions for inital job start up;
4. determine the amount of register error in the system;
5. calculate the amount of error correction required;
6. display on panel 62 the amount of error;
7. control the speed of register control motor 30 to correct the error and establish the proper speed match.

Referring to FIG. 1, controller 80 comprises and is associated with various circuits designated A through M.

Circuit A is a memory circuit for base speed and dancer position signals.

Circuit A′ is a battery-powered back-up for memory circuit A.

Circuit B is an error measuring circuit.

Circuits C and G convert the frequency of pulsed signals to analog voltage signals.

Circuit D′ provides a base speed output signal.

Circuit D is a multiplying digital to analog converter.

Circuit E is a switch circuit which turns on for a time interval of 120 to 160 milliseconds during which an instantaneous error correction signal is to be applied.

Circuit F provides an output signal based on data pertaining to instantaneous errrors measured for each register mark.

Circuit H is a summing circuit for summing the base speed signal and an instantaneous error correction signal.

Circuit I contains the pushbutton switches 64, 66, 68 and 70.

Circuit J' detects a register mark and determines if it is a proper mark of predetermined size.

Circuit J determines if a register mark is in a predetermined position relative to the cutter mechanism (i.e., in register), and, if not, measures the error and provides a register error signal.

Circuit K is a digital PID circuit (proportional integral differential circuit) for processing either a register mark error signal or a dancer position error signal (not both simultaneously) and transmits it to circuit F.

Circuit K' calculates long-term errors, for example eight errors, to detect a trend and direction of trend and provides an output signal to provide a correction signal which is sent to base speed output circuit D' which feeds circuit D.

Circuit M communicates the register mark error signal to circuit K.

OPERATION

As previously mentioned, to obtain register control, it is necessary to match and maintain the surface speed of metering roll 18 to the surface speed of impression cylinder 10 at some selected base speed and this is acomplished by operating main drive motor 32 and adjusting the speed of register control motor 30. The base speed of motor 30 is controlled by metering roll encoder 40 driven by metering roll 18 and by tachometer 46 of register control motor 30. The electronics in or associated with controller 80, including circuits C, D, D' and H, are designed to maintain a fixed ratio between encoder 40 and tachometer 46, thereby assuring a matched base surface speed, regardless of the line speed selected.

The base speed of motor 30 is established during initial set-up. After the desired repeat length in inches has been entered into the display 62 register control unit 60, the line can be run at any speed with or without web W. The register control means counts pulses from encoder 40 of metering roll 18. The length of feed-up per repeat can be determined from the number of pulses received. The speed of motor 30 is then adjusted until the number of pulses received per repeat is equal to the value initially entered into the register control unit display 62. The control means has circuits which set-up the parameters automatically at the start of a job. This parameter information remains in memory circuits A until the job is completed and a new one is started.

At the start of a job the operator presses the "set up" switch 70 to enter the repeat length L for the blank to be cut. Once entered, cutter-creaser mechanism 26 is started and the initial value for the control of register control motor 30 is obtained in two stages. In the first stage, the pulses received from metering roll encoder 40 are counted per each repeat length. Since each pulse represents 0.001 inches, for example, the control voltage to register control motor 30 is modified until the number of pulses counted is equal to the repeat length the operator has entered. At this point the first stage of the set-up is complete. Once this first stage is completed, the second stage is started.

The second stage of set-up requires web W to be used in cutter mechanism 26. If any movement of dancer 12 is seen, the signal to motor 30 will be adjusted. During the second stage the position of dancer 12, located between the printing cylinder 10 and cutter mechanism 26, is monitored. The second stage is used to fine tune the control voltage used to control register control motor 30. The register control means operates dancer adjustment means 15 to cause web W to force dancer 12 to the center of its range i.e., null position. Dancer position sensèr 36 then monitors the position of dancer 12 for any movement. The amount of movement, along with the direction of movement sensed, again causes the speed of motor 30 to be adjusted until dancer 12 is stable. Once dancer 12 is stable, the amount of web W being fed into cutter mechanism 26 is exactly equal to the amount of web being outputted from the printing rolls 10 and 11. At this point the set-up is completed. The controller 80 continues to monitor dancer position and make corrections until there is no more movement in dancer 12. At this time controller 80 drops out of the set-up mode and operates in the manual mode of operation.

With set-up complete, the register control means is in a manual mode of operation. The "ADV" and "RET" switches 64 and 66, respectively, can be used to move the print-to-cut into proper register. Once proper print-to-cut registration is obtained, the operator presses "AUTO" switch 68 to start automatic correction.

When the "AUTO" switch 68 is pressed, controller 80 scans printed web W, which is passing mark scanner 38, looking for the predefined proper mark 54. If the proper mark cannot be identified, or if two marks of the proper width are found, an error code appears on display 62 of control unit 60. When the proper mark 54 is found, the controller 80 starts to effect register control. Once the proper printed mark 54 is found, the register control means automatically corrects for any register error seen. The error measurement control circuit J in controller 80 counts encoder pulses from cut-stroke signal generator 44 in cutter mechanism 26 to establish an area or measuring window, within the repeat where the identified register mark 54 will appear. With the measuring window established, the error measurement control circuit J compares the actual location of printed mark 54 to a location stored in a memory circuit A indicating where the proper location of mark 54 should be for each repeat. The difference between these values is the amount of register error. The error amount is generated from metering roll encoder 40 driven by metering roll 18, and is given in thousandths of an inch. This value is both displayed on front panel display 62 of register control unit 60 and is also used in two separate control functions to adjust the speed of register motor 30 to correct for that amount of error.

First, the error signal is determined by placing the current error value into a PID calculation in circuit K. The resulting error value gives an indication of the current error and a trend of error over the last four repeats. The PID calculated error value, as a corrective gain signal, is then summed in circuit H with the control signal to the motor controller 50 for register motor 50 for a 120 to 160 millisecond period of time to adjust the speed of motor 30. This process occurs for each impression stroke of cutter mechanism 26 and a momentary speed match adjustment is used to offset any measured register error.

Once the error amount is known and displayed on display 62, the "ADV" or "RET" indicator lights in pushbutton switches 64 or 66, respectively, flash to indicate the direction of the error.

Second, a second PID calculation and corrective gain calculation is performed in circuit L. This calculation determines if and how much correction is required to the base register control motor 30 control signal. This signal compensates for long term changes in web condition and in web characteristic differences after a splice, for example. The results of this calculation is the new current control signal for register control motor 30.

The second function uses the error value to adjust the control signal used to determine the base speed for register control motor 30. The base speed of motor 30 is the speed the motor will be running at constantly, with no error correction. This speed was initially established during the set up function. A long term value is determined by placing the current error value into the second PID calculation referred to above. The calculated error value is then summed with the current value used to control the speed of motor 30. The resulting correction from this calculation corrects for errors consistently in one direction, indicating that change in the base speed of motor 30 is required.

While the register control means is operating in automatic correction mode, the operator can change the print-to-cut register location by pressing the "ADV" or "RET" switches 64 or 66, respectively, at any time.

A critical element of the print-to-cut register control means for in-line rotogravure operation is the air-loaded dancer 12 located between impression cylinders 10 and 11 and metering rolls 18. The function of dancer 12 is to minimize tension shocks generated by cutter mechanism 26 from being transmitted back into the impression cylinders 10 and 11. Once the print-to-cut register phase has been established, there is only one "right" or null position for dancer 12 in normal operating circumstances, depending on the repeat length selected. When the line is stopped, and impression roll 10 is raised, tension levels within press CP will be disturbed. Upon returning to the line run mode, dancer 12 may locate in the wrong position. To avoid creating unncessary start-up waste, the register control system stores in memory A the proper position of dancer 12 prior to the line being stopped. On line start, the speed of metering roll 18 is adjusted until dancer 12 is returned to its proper (i.e., null) position before going into automatic error correction mode. In operation, the control means monitors register mark 54 located on web W. An error measurement is determined and a correction or control signal is sent to register control motor 30.

An additional function of the improved register control means is to monitor dancer position, which is directly related to the location of print-to-cut registation. Any change in print-to-cut location also changes the dancer location. The location of dancer 12 is monitored for each repeat and stored in memory circuit A. On line starts, controller 80 controls the speed of register motor 30 until dancer 12 is back to the same location (null position) it was at when the line stop occurred. This allows the print-to-cut register to start at the same location it was at before press CP was stopped. A second condition during line start is to monitor a sequencing distance of web W which must expire before controller 80 will start correction. This ensures that a new printed web is being looked at for determining the amount of error.

As FIG. 1 schematically shows, the register control means comprises several subcircuits which are generally identified by the capital letters A trough M and the function of these subcircuits is indicated by the legends in FIG. 1.

FIGS. 5 through 12 depict these subcircuits in detail and the same capital letters A through M are employed to relate them to FIG. 1. The subcircuits depicted in FIGS. 5 through 12 contain solid state components and other electrical components which are depicted by their conventional electrical symbols and also by their standard industry coded designations.

FIGS. 5 through 12, taken together, comprise a complete circuit diagram. FIGS. 5, 6, 7, and 8 define the top of the diagram proceeding left to right. FIGS. 9, 10, 11 and 12 define the bottom of the diagram proceeding left to right. Adjacent figures overlap to show continuity.

We claim:

1. Register control means for web processing apparatus to match the surface speed of a metering roll which supplies a pre-printed web to a cutting zone in a cutter mechanism to the surface speed of an impression cylinder which applies impressions and associated register marks to said web and to effect registration between said impressions and said cutting zone, said apparatus comprising a register control motor for said metering roll and a movable dancer engageable with said web at a location between said impression cylinder and said metering roll, said register control means comprising:

base speed selector means for operating said register control motor to establish and maintain a base speed for said web;

error correction means for ascertaining a register error, if any, and for adjusting said base speed to establish a corrected base speed to eliminate said register error;

dancer position locater means for ascertaining and remembering a null position assumed by said dancer when said web is operating at said corrected base speed; and for subsequently recalling said null position to enable an initial operation of said register control motor at a speed wherein said dancer assumes said recalled null position.

2. Register control means according to claim 1 wherein said base speed selector means includes means for sensing and comparing the speed of said metering roll and said register control motor and for providing a base speed signal for operating said register control motor to maintain said base speed.

3. Register control means according to claim 1 or 2 wherein said error correction means includes means for sensing the operational speed of said cutter mechanism and the location of said register marks relative to said cutting zone at said operational speed to ascertain a register error signal, if any, and for providing a speed correction signal based on said error signal to operate said register control motor at said corrected base speed.

4. Register control means according to claim 1 or 2 wherein said dancer position locater means includes means for sensing the position of said dancer, memory means for storing a null signal representing said null position, comparator means for comparing incoming signals representing actual dancer position to said stored null signal, and for providing a signal to operate said register control motor at a speed which maintains said dancer in said null position.

5. Register control means according to claim 4 wherein said dancer position locater means includes means to selectively move said dancer to said null position when said dancer is not engaged with said web.

6. In combination:

web processing apparatus comprising:

an impression cylinder (10) for forming a succession of impressions (52) and associated register marks (54) on a web (W);

a cutter mechanism (26) having a cutting zone (27) wherein blanks containing said impressions (52) are cut from said web (W);

a rotatable metering roll (18) for continuously feeding said web (W) from said impression cylinder (10) to said cutter mechanism (26);

an adjustable speed register control motor (30) for rotatably driving said metering roll (18);

a movable dancer (12) engaged with said web (W) at a location between said impression cylinder (10) and said metering roll (18), said dancer (12) assuming a predetermined dancer position when said register control motor (30) operates at a speed at which said impressions (52) are in registry with said cutting zone (27);

and selectively operable dancer position adjustment means (15) for moving said dancer (12) when the latter is disengaged from said web (W);

and register control means comprising:

a dancer position sensor (36) for providing dancer position signals;

a register mark scanner (38) for sensing register mark positions at a location upstream of said metering roll (18) and for providing register mark position signals;

a metering roll encoder (40) driven by said metering roll (18);

a tachometer (46) driven by said register control motor (30);

a cut-stroke signal generator (44) driven by said cutter mechanism (26);

a control panel (60) comprising a digital visual display (62) and manually operable switches for providing switch signals and including an automatic/-manual selector switch (68), a setup switch (70), a web advance switch (64) and a web retard switch (66);

and an electronic controller (80) comprising circuits for receiving and processing said switch signals, and signals from said sensor, scanner, encoder, tachometer, and signal generator, said circuits including:

base speed circuit means (I) responsive to switch signals from said set-up switch (70) to provide a base speed control signal to effect operation of said register control motor (30) at a selected base speed and to effect a numeric display of said selected base speed on said digital display (62);

circuit means to receive and process signals from said metering roll encoder (40) and said tachometer (46) and to provide a correction control signal to said base speed control signal to maintain a predetermined fixed speed ratio between said output signals from said metering roll encoder (40) and said tachometer (46);

circuit means (J) for counting the number of metering roll encoder pulses provided by said metering roll encoder (40) which occur in an interval of time between a cut-stroke signal representing the arrival of a register mark (54) at said register mark sensor (38) and the subsequent occurrence of a signal from said cut-stroke signal generator (44) representing an operation of said cutter mechanism (26);

memory circuit means (A) for storing a predetermined number representing said predetermined repeat length;

circuit means (K) for comparing the number of metering roll encoder pulses occurring during said interval of time to said predetermined number stored in said memory circuit (A) to provide a digital error count signal representing the direction and magnitude of misregistration error and to effect display of said error count signal;

a digital-to-analog converter circuit (G) to convert said digital error count signal to an analog error signal;

a circuit (J) for counting the number of said error correction signals which were applied to effect elimination of said register error, a circuit (M) for transmitting said count, a circuit (F) for adding those error correction signals which are positive and for subtracting those error correction signals which are negative, and a circuit (H) to provide an analog DC voltage error signal which is to be added to or subtracted from said base speed control signal to effect a change in the rotational speed of said register control motor (30);

the PID circuit (H,G,E,F and K) to receive said analog voltage DC error signal and to ascertain the trend and average magnitude of said error over a fixed period of time and to thereby provide an error correction signal which is momentarily applied by circuit (H) to base speed control signal for said register control motor (30) to thereby adjust the speed of said metering roll (18) to the speed of said printing cylinder (10);

circuit means (B) to sense the position of said dancer (12) and to provide a dancer position signal whose value relates to dancer position;

memory circuit means (A) to store the value of said dancer position signal which represents dancer null position which is provided when said analog error correction signal is eliminated;

and circuit means (K) to compare the value of a dancer position signal, which is provided when a corrected base speed signal is being provided, to the stored null position signal value and for providing a dancer control signal for said dancer adjustment means (15) to adjust the position of said dancer (12) in accordance with said stored position signal when said web (W) is not engaged with said dancer (12).

* * * * *